US005511997A

United States Patent [19]

Yoshida

[11] Patent Number: 5,511,997

[45] Date of Patent: Apr. 30, 1996

[54] MOUNTING ARRANGEMENT FOR OUTBOARD MOTOR

[75] Inventor: Sadato Yoshida, Hamamatsu, Japan

[73] Assignee: Sanshin Kogyo Kabushiki Kaisha, Hamamatsu, Japan

[21] Appl. No.: 302,122

[22] Filed: Sep. 7, 1994

[30] Foreign Application Priority Data

Sep. 7, 1993 [JP] Japan ..... 5-221840

[51] Int. Cl.[6] ..... B63H 20/02

[52] U.S. Cl. ..... 440/52; 248/635; 248/640; 248/643

[58] Field of Search ..... 440/52; 248/609, 248/635, 638, 643, 640, 641

[56] References Cited

U.S. PATENT DOCUMENTS 2,916,007 12/1959 Kiekhaefer ..... 440/638 X
5,180,319 1/1993 Shiomi et al. ..... 440/52

*Primary Examiner*—Sherman Basinger
*Attorney, Agent, or Firm*—Knobbe, Martens, Olson & Bear

[57] ABSTRACT

An improved mounting arrangement for mounting of an outboard motor on the transom of an associated watercraft embodying elastic mounts comprised of an inner tube, an outer tube, and an interposed elastic member. The inner tube defines a cavity that receives the elastic member that is non-circular in cross section so as to permit a greater volume of damping material in a given spatial relationship.

6 Claims, 5 Drawing Sheets

MOUNTING ARRANGEMENT FOR OUTBOARD MOTOR

BACKGROUND OF THE INVENTION

This invention relates to a mounting arrangement for an outboard motor, and more particularly to an improved elastic mounting for the components of an outboard motor.

As is well known, outboard motors are normally mounted on the transom of a watercraft for transmitting a propulsion force from the outboard motor to the watercraft. In conjunction with doing this, it is desirable to ensure in the mounting arrangement that the vibrations generated by the outboard motor in its operation are not transmitted to the hull of the watercraft. However, the propulsion forces should be transmitted. This prevents obvious difficulties.

Normally, the outboard motor is mounted resiliently by attaching a steering shaft to the drive shaft housing in a resilient manner. The steering shaft is then journaled in a swivel bracket, which is pivotally connected to a clamping bracket for tilt and trim movement. The resilient mounting for the steering shaft should isolate the vibrations of the powering internal combustion engine and the forces generated by vibration of the propeller from the hull but should be sufficiently rigid so as to transfer the driving thrust.

A wide variety of types of mounting arrangements have been employed, and these normally include an elastic bushing that has a connection to the drive shaft housing and to the steering shaft for providing the force transmission. However, due to the compact nature of the construction, it is not possible to provide the volume of elastic necessary to provide both the damping and the force transmission.

One reason for this is that a typical type of mount employs an annular elastic member that is cylindrical in shape and which has its outer periphery clamped to the outboard motor and its inner periphery affixed to the steering shaft. These outer and inner peripheries are both cylindrical in shape, and hence, the volume of elastic which can be utilized, and accordingly the stiffness, is somewhat limited, as will be described later.

It is, therefore, a principal object of this invention to provide an improved elastic mounting arrangement for an outboard motor that provides adequate elastic for damping and also provides good force transmission in a compact nature.

It is a further object of this invention to provide an improved mounting arrangement for the steering shaft of an outboard motor to the housing assembly of the outboard motor, achieving the aforenoted results.

In connection with the mounting of the elastic, if the elastic is itself directly engaged with the respective elements that mount it, then wear of the elastic can result. It is, therefore, a further object of this invention to provide an improved mounting arrangement for an elastic support for an outboard motor wherein the elastic is protected from wear.

SUMMARY OF THE INVENTION

This invention is adapted to be embodied in an outboard motor mounting arrangement for mounting an outboard motor element elastically to an associated watercraft. The mounting arrangement is comprised of an inner tube that is adapted to be affixed to one of the elements and the watercraft and an outer tube that telescopically receives the inner tube and which is adapted to be affixed to the other of the element and the watercraft. A non-circular elastic element is bonded to the inner and outer tubes to provide an elastic interconnection between them.

DETAILED DESCRIPTION OF THE PREFERRED EMBODIMENT OF THE INVENTION

Figure 1:
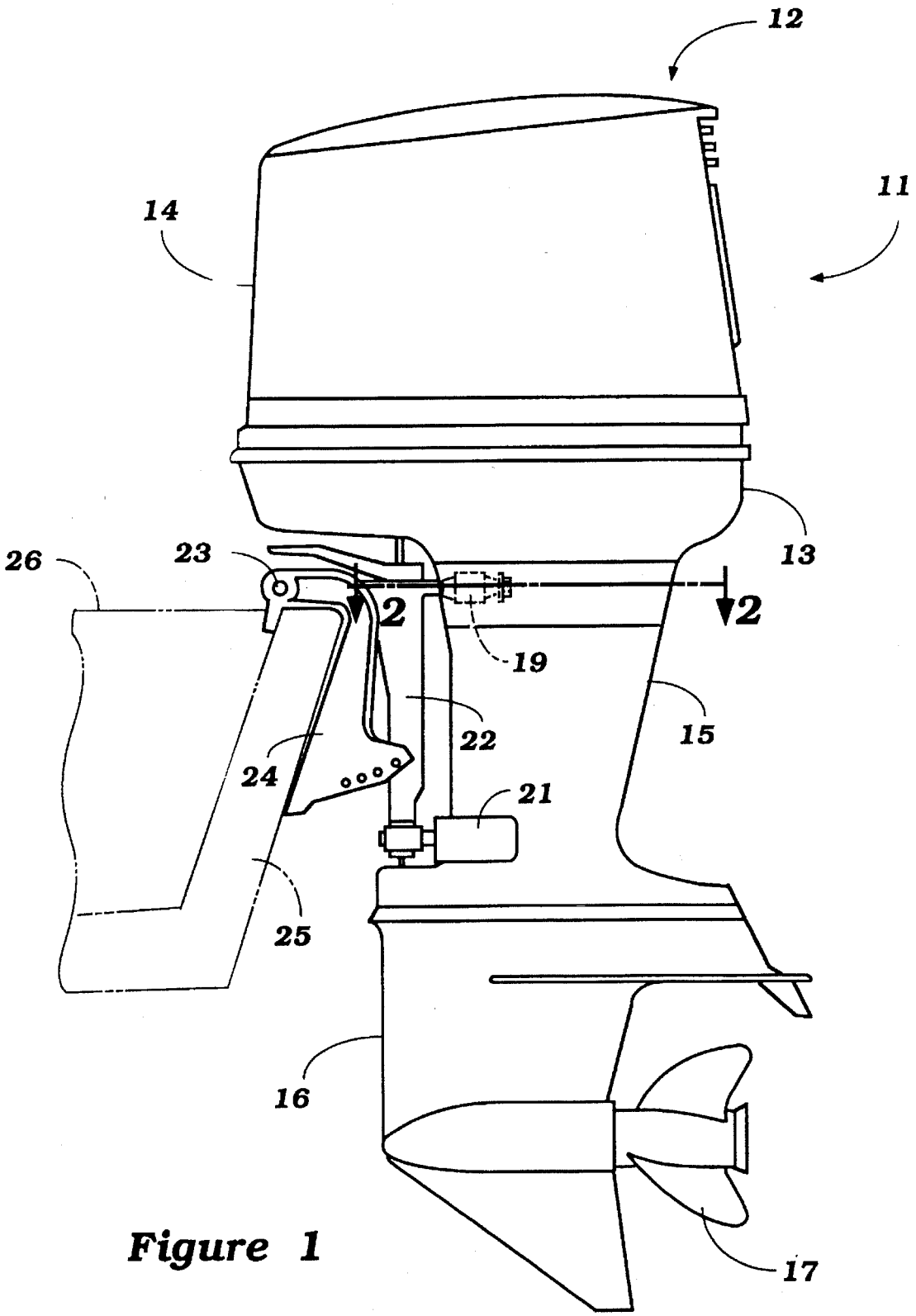
FIG. 1 is a side elevational view of an outboard motor constructed in accordance with an embodiment of the invention.
Figure 2:
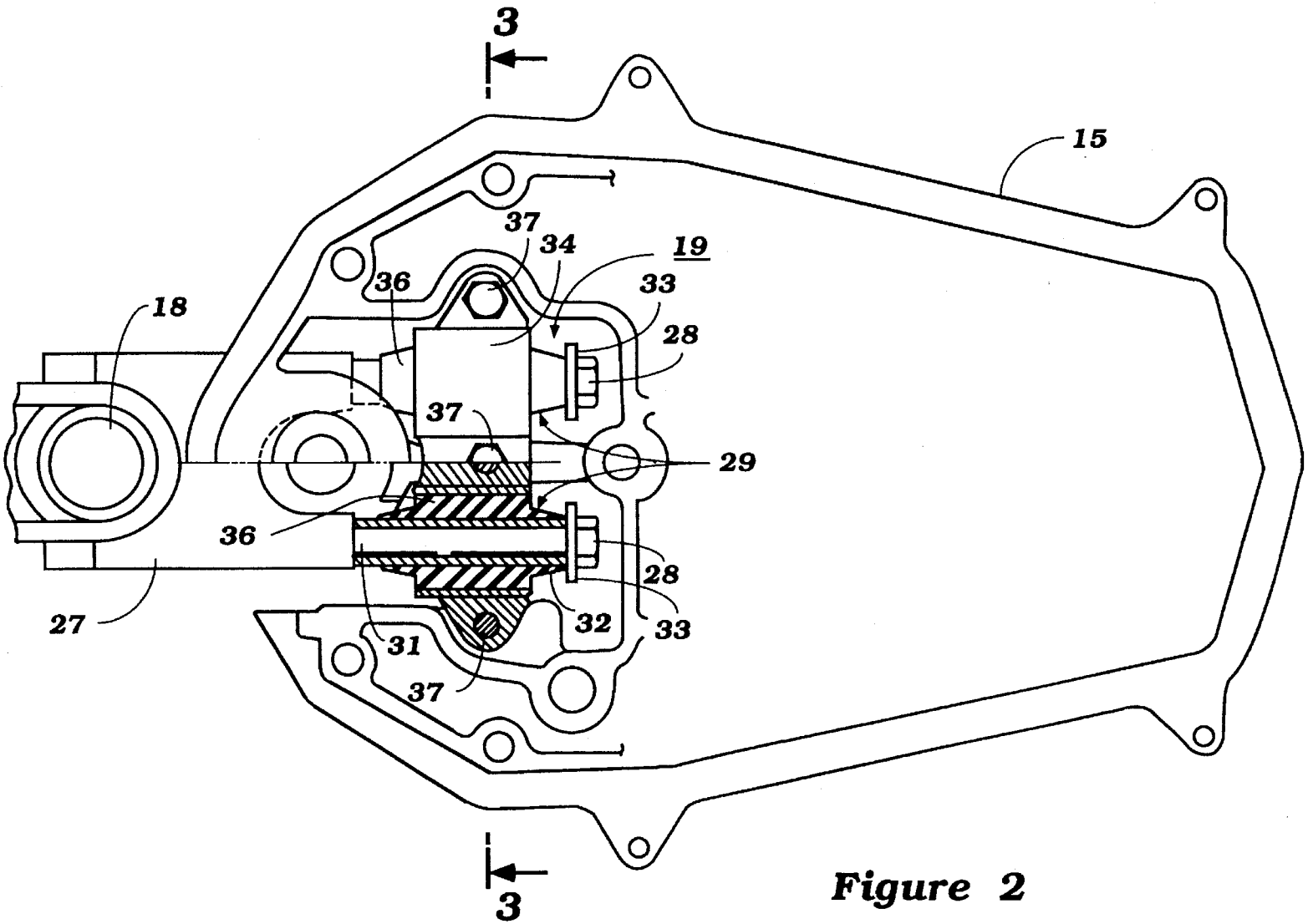
FIG. 2 is an enlarged view showing the mounting arrangement for the outboard motor and which is taken generally along the line 2—2 of FIG. 1.

Referring first in detail to FIG. 1, an outboard motor constructed in accordance with an embodiment of the invention is identified generally by the reference numeral 11. The outboard motor 11 includes a power head 12 which is comprised of a powering internal combustion engine, which is not illustrated and which may be of any known type. This engine is surrounded by means of a protective cowling, including a lower tray 13 and an upper main cowling portion 14 that is adapted to be detachably affixed to the tray in any known manner.

As is typical with outboard motor practice, the engine of the power head 12 is mounted so that its output shaft rotates about a vertically extending axis and which drives a drive shaft contained within a drive shaft housing 15 that depends from the tray 13 of the power head 11. This drive shaft then terminates in a lower unit 16 where it drives a forward/neutral/reverse transmission (not shown) of a conventional nature for driving a propeller 17 in forward and reverse directions.

It should be understood that the construction of the outboard motor 11 as thus far described may be considered to be conventional, and for that reason the internal details of the outboard motor 11 are not believed to be necessary to understand the construction and operation of the invention. For that reason, where any details of the outboard motor 11 are not illustrated or described, they may be considered to be conventional.

A steering shaft, indicated generally by the reference numeral 18, is affixed to the drive shaft housing 15 by means of an upper elastic isolator assembly 19 and a lower isolator assembly 21. The invention deals primarily with the upper elastic isolator assembly 19, and this will be described in more detail later by reference to the remaining figures.

This steering shaft 18 is journaled for steering motion about a generally vertically disposed steering axis within a swivel bracket 22. The swivel bracket 22 is, in turn, pivotally connected by means of pivot pin 23 to a clamping bracket 24. The pivot pin 23 permits tilt and trim adjustment of the outboard motor 11, as is well known in this art. The clamping bracket 24 includes a clamping device (not shown) for attaching the outboard motor 11 to a transom 25 of an associated watercraft 26, which is shown only partially and in phantom.

As has been noted, the elastic mountings 19 and 21 are designed so as to permit vibration isolation between the outboard motor 11 and the mounting assembly, and specifically the transom 25. Although the lower assembly 21 may be of any conventional type, the upper assembly 19 does embody the invention, and it may be understood that a similar arrangement may also be employed at the lower assembly 21. This assembly will now be described by particular reference to FIGS. 2–5.

The steering shaft 18 has affixed to it a supporting plate 27, which supporting plate has a pair of tapped openings at its rear end which receive threaded fasteners 28. These threaded fasteners 28 are, in turn, affixed to a plate portion 30 of the drive shaft housing 15 by the elastic isolator 19, which is comprised of a pair of elastic members 29 that have a construction as will be described.

Basically, the fasteners 28 have shank portions 31 that pass through the hollow interior of a pair of inner tubes 32. The inner tubes 32 are formed from metal of a suitable type and extend between washers 33 that are engaged with the heads of the bolts 28 and engage at their opposite ends the mounting element 27. As a result, the inner tubes 32 are rigidly affixed to the steering shaft 18. The inner tubes 32 are, as shown in the figures, cylindrical tubes.

Figure 3:
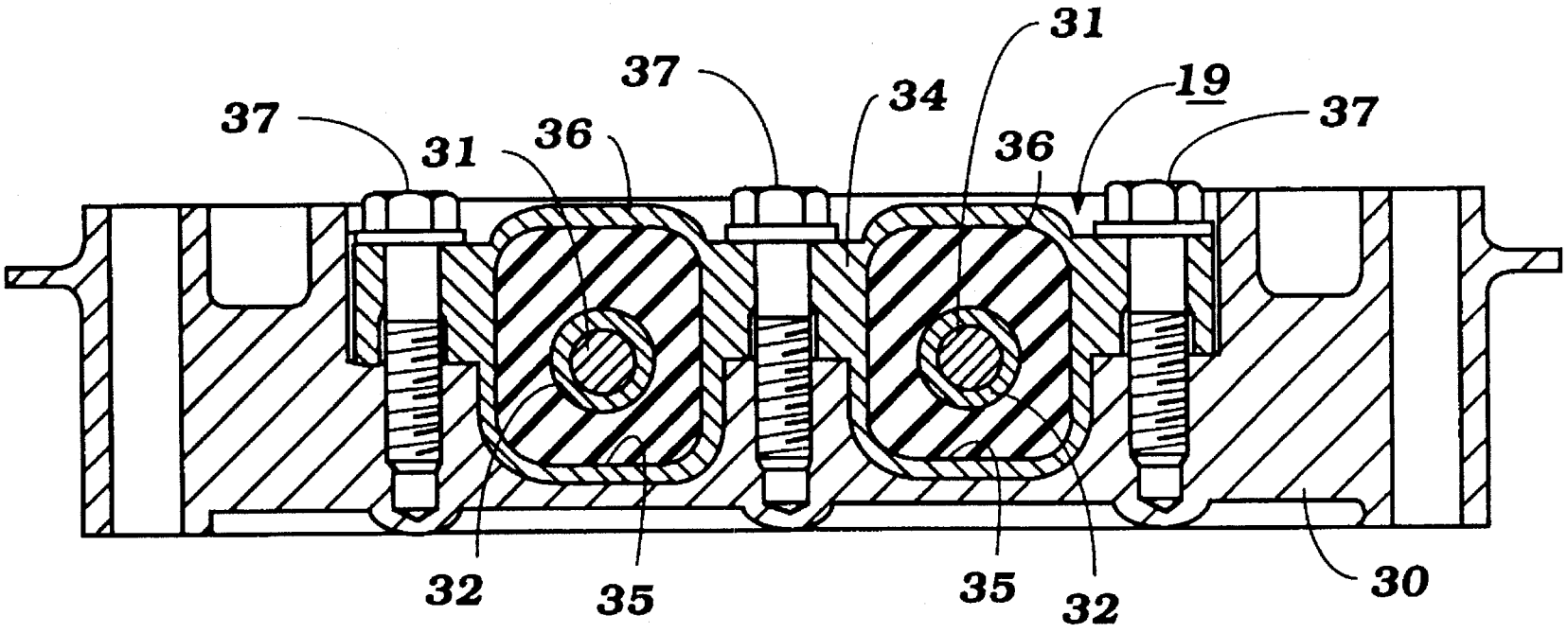
FIG. 3 is a cross-sectional view taken along the line 3—3 of FIG. 2.

An outer tube-forming member, indicated generally by the reference numeral 34, forms a common outer tube for each of the inner tubes 32, but which is held in spaced relationship thereto. The outer tube-forming member 34 defines a pair of rectangular recesses 35 which are generally symmetrically disposed to the inner tubes 32, but it will be noted that the inner tubes 32 are disposed more toward the lower portion of the recesses 35 in a vertical direction, as shown in FIG. 3, but symmetrically about a vertical plane.

A pair of elastic bodies 36 are bonded to the inner tubes 32 and each of the recesses 35 of the outer tube-forming member 34 by a suitable process such as vulcanizing or the like. The elastic members 36 may be formed of rubber or a rubber-like material so as to provide the desired damping characteristics. As may be seen in FIG. 2, the outer tube-forming member 34 has a lesser dimension in the direction of the axes of the threaded fastener portions 31, and the elastic bodies 36 have a portion that fills their cavities and a somewhat smaller portion that extends axially there beyond along the length of the outer tube 32, terminating at the washer 33 but short of the face of the mounting element 27. This provides the desired degree of fore and aft rigidity for transmitting axial driving thrust.

Figure 4:
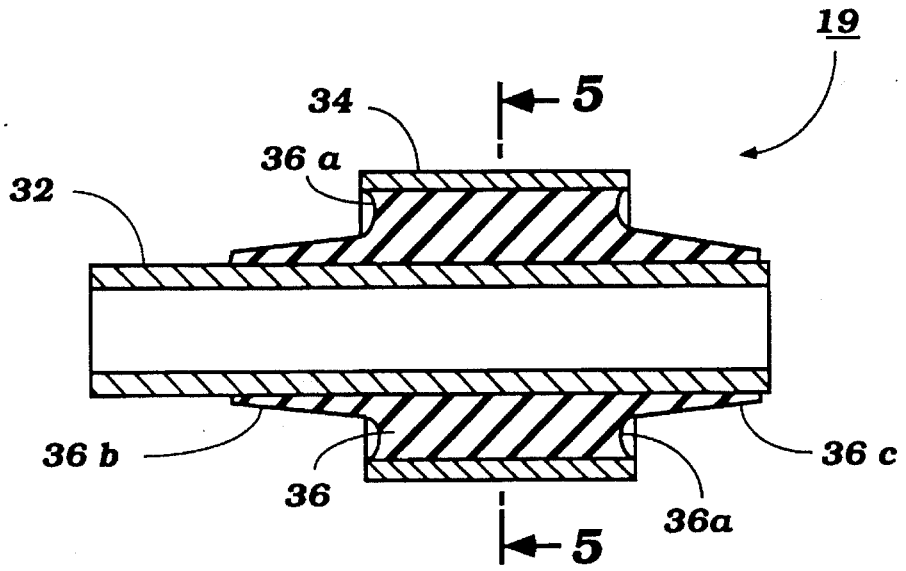
FIG. 4 is an enlarged cross-sectional view illustrating one of the elastic mounts.
Figure 5:
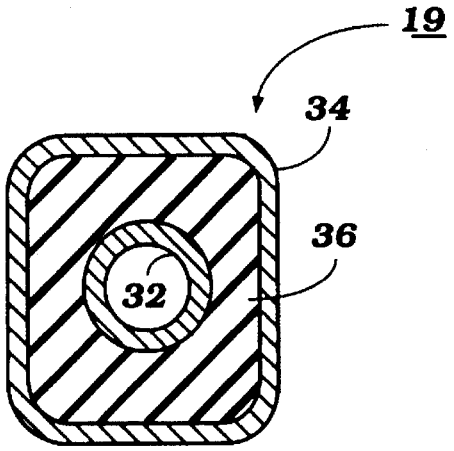
FIG. 5 is a cross-sectional view taken along the line 5—5 of FIG. 4.

The outer tube-forming member 34 is affixed to the plate 30 in a complementary recess thereof by means of a plurality of threaded fasteners 37. Although the construction employs a single outer tube-forming member 34, it should be readily apparent to those skilled in the art that the device may be comprised of two separate elastic elements, each having an outer tube, an inner tube, and an interposed elastic body, and such separate devices are shown in FIGS. 4 and 5, with these figures being used primarily for purposes of description of the properties of the device.

In describing the properties, reference will now be made particularly to FIGS. 4 and 5, and the mathematical analysis of the operation and construction will be described by reference to FIGS. 6 and 7. In FIGS. 4 and 5, the elastic mounting device has been indicated by the reference numeral 19, and this shows only a single one of the inner and outer tubes, as applied in FIGS. 2 and 3. However, where the components are the same, they have been identified by the same reference numerals, even though there are separate elements illustrated in FIGS. 4 and 5 and a combined element illustrated in FIGS. 2 and 3. It should be noted that the elastic element 36 has recesses **36*a* formed at opposite ends where it is joined with the outer tube 34 and which blend into the elongated portions indicated at 36*b* and 36*c***, respectively.

Figure 6:
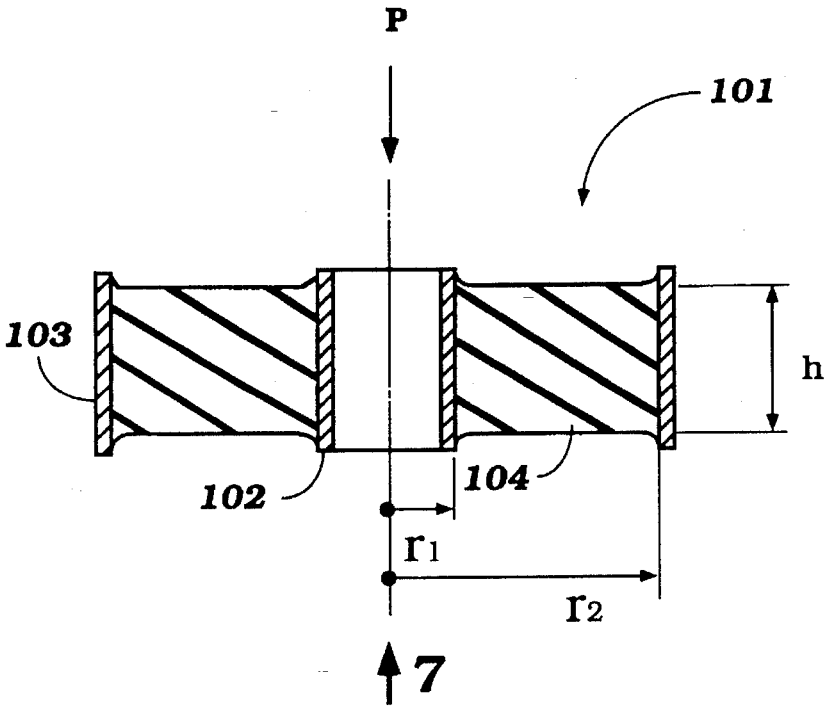
Figure 6 Prior Art
FIG. 6 is a cross-sectional view, in part similar to FIG. 5, and shows a prior art type of construction.

FIG. 6 shows a prior art type of construction, which is indicated generally by the reference numeral 101, and includes a cylindrical inner tube 102 and a cylindrical outer tube 103, with the interposed elastic body being indicated by the reference numeral 104. It may be seen that the volume of the elastic body 104 is defined between an inner radius R1 (the outer diameter of the inner tube 102), an outer diameter defined by the radius R2 (which is defined by the inner radius of the outer tube 103), and a height or length H. The driving thrust is existent in the direction indicated by the arrow P in FIG. 6. Hence, the elastic device defines a spring constant $k_p$ in the direction of the load P, which is expressed as follows:

$$k_p=2\pi h/\ln(r_2/r_1)\times G^* \quad (1)$$

G* is an apparent modulus of rigidity. If the modulus of rigidity of the spring element 104 is defined as G, G* is expressed as:

$$G^*=G/\{1+1/3\times(r_2-r_1)^2\} \quad (2)$$

It is clear from the Equation (1) that the larger the external diameter $r_2$, the smaller the spring constant $k_p$ becomes. However, the total volume of the elastic body 104 is limited with the prior art construction because of the requirements to maintain a compact construction, particularly as necessitated by the compact nature of outboard motors. Thus, because of the use of a cylindrical body as previously employed, the amount of stiffness in the axial direction is reduced; and in order to provide the desired stiffness, very stiff materials must be employed, and this reduces the damping in the vertical and transverse horizontal direction.

Figure 7:
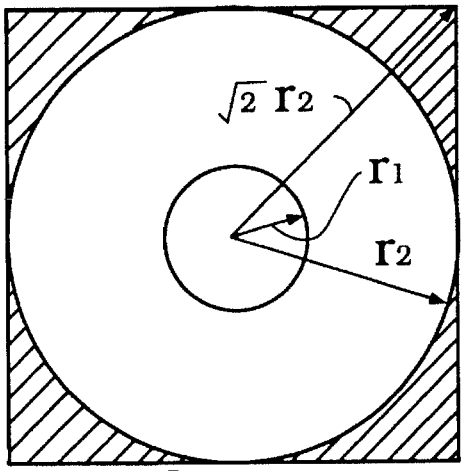
FIG. 7 is a view looking in the direction of the arrow 7 in FIG. 6 and shows how the present invention improves the amount of elastic that can be used within the same area relative to the prior art type of construction.

As may be seen, if a rectangular configuration is employed as shown in FIG. 7, the effective area can be increased, as shown by the shaded line area with the diagonal dimension indicated as $\sqrt{\sqrt{2}}\, r_2$. This has the effect of increasing the radius $r_2$ in Equation 1 from 1 to about $\sqrt{\sqrt{2}}\, r_2$.

In addition to the aforenoted advantages of increasing the volume of the elastic material in a given space, as shown in FIG. 3, this further permits the offsetting of the inner tube 32 relative to the outer tube cavity 35 so as to provide a greater vertical damping in one direction than the other while maintaining the same transverse horizontal damping in both directions. Of course, this is possible by using a rectangular, rather than a square, outer tube. Of course, the specific relationships can be altered to suit the particular characteristics of the outboard motor.

It should be readily apparent that the described construction provides much better damping and force transmission in a given spatial relationship than the prior art cylindrical tubular types. Of course, the foregoing description is that of a preferred embodiment of the invention, and various changes and modifications may be made without departing from the spirit and scope of the invention as defined by the appended claims.

I claim:

1. An outboard motor mounting arrangement for mounting of an outboard motor drive shaft housing element elastically to an associated watercraft through a steering shaft, said mounting arrangement being comprised of a pair of spaced apart rigid inner tubes each having an opening receiving first fastening means for providing a direct connection to said steering shaft on opposite sides thereof and a rigid integral outer member defining a pair of outer tubes each telescopically receiving a respective one of said inner tubes and having an opening receiving second fastening means for providing a direct connection to said drive shaft housing element, and a pair of non-circular elastic members each bonded to said inner and said outer tubes for forming an integral assembly comprised of said outer member, said pair of inner tubes and said pair of non-circular elastic members.

2. An outboard motor mounting arrangement as in claim 1, wherein one of the inner and outer tubes is non-circular.

3. An outboard motor mounting arrangement as in claim 2, wherein the outer tubes are non-circular.

4. An outboard motor mounting arrangement as in claim 3, wherein the outer tubes are rectangular.

5. An outboard motor mounting arrangement as in claim 4, wherein the rectangular configuration has a greater height in a vertical direction than a width in the horizontal direction as mounted.

6. An outboard motor mounting arrangement as in claim 5, wherein the inner tubes are disposed closer to the bottom of the outer tubes than to the top of the outer tubes so as to provide more elastic material vertically above the inner tubes than vertically below the inner tubes.

* * * * *